US006210291B1

(12) United States Patent
Kato et al.

(10) Patent No.: US 6,210,291 B1
(45) **Date of Patent: *Apr. 3, 2001**

(54) GOLF BALL

(75) Inventors: Akira Kato; Yoshikazu Yabuki; Hiroshi Hirata; Naoki Kato; Yoshinori Sano, all of Shirakawa (JP)

(73) Assignee: Sumitomo Rubber Industries, Ltd., Hyogo-ken (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/834,553

(22) Filed: Apr. 4, 1997

(30) Foreign Application Priority Data

Apr. 4, 1996 (JP) ..... 8-082405
Nov. 19, 1996 (JP) ..... 8-307761

(51) Int. Cl.[7] ..... A63B 37/06
(52) U.S. Cl. ..... 473/357
(58) Field of Search ..... 473/357, 377, 473/374

(56) References Cited

U.S. PATENT DOCUMENTS 5,439,227 * 8/1995 Egashira et al. ..... 473/377 X
5,445,387 * 8/1995 Maruko et al. ..... 473/357 X

FOREIGN PATENT DOCUMENTS 0674923 10/1995 (EP) .
2299275 10/1996 (GB) .
2301291 12/1996 (GB) .
2307865 6/1997 (GB) .

* cited by examiner

*Primary Examiner*—Mark S. Graham
(74) *Attorney, Agent, or Firm*—Birch, Stewart, Kolasch & Birch, LLP

(57) ABSTRACT

The present invention provides a golf ball exhibiting excellent shot feel, long flight distance and easy applicability of spin when hit by short irons. The golf ball comprises a thread wound core and a cover covering the thread wound core, the thread wound core comprising a solid center and a thread rubber layer formed by winding thread rubber around the solid center, wherein the solid center has a diameter of 30 to 38 mm, a surface hardness, determined by JIS-C hardness meter, of 40 to 90 and a hardness difference between the center point and the surface, determined by JIS-C hardness meter, of within 5, the solid center also has a deformation amount of 0.5 to 2.5 mm, the deformation amount being determined by applying a weight of from an initial load of 10 Kg to a final load of 30 Kg on the solid center and measuring a change of the deformation of the solid center by mm, and the cover is formed from a base resin mainly containing an ionomer resin and has a flexural modulus of 50 to 300 MPa and a Shore D hardness of 40 to less than 60.

1 Claim, 1 Drawing Sheet

GOLF BALL

FIELD OF THE INVENTION

The present invention relates to a golf ball. More particularly, it relates to a golf ball exhibiting excellent shot feel, long flight distance and easy applicability of spin when hit by short irons.

BACKGROUND OF THE INVENTION

There are two types of golf balls currently commercial selling. One is a solid golf ball, such as two piece golf ball, which comprises a core formed from integrally molded rubber material and a cover formed from thermoplastic resin (e.g. ionomer resin), covered on the core. The other is a multi-layer structured golf ball having a thread rubber layer, which comprises a solid or liquid center, a thread wound layer formed by winding thread rubber on the center and a cover for covering on the thread wound layer. The multi-layer structured golf ball, especially one having liquid center and balata cover, is preferably used by high level golfers or professional golfers, because it has excellent shot feel and good controllability. However, the mult-layer structured golf ball having a thread rubber layer exhibits too much spin amount and a low launch angle, thus producing poor flight distance and poor durability and poor cut resistance, in comparison with the solid golf ball, especially the two piece solid golf ball.

SUMMARY OF THE INVENTION

Figure 1:
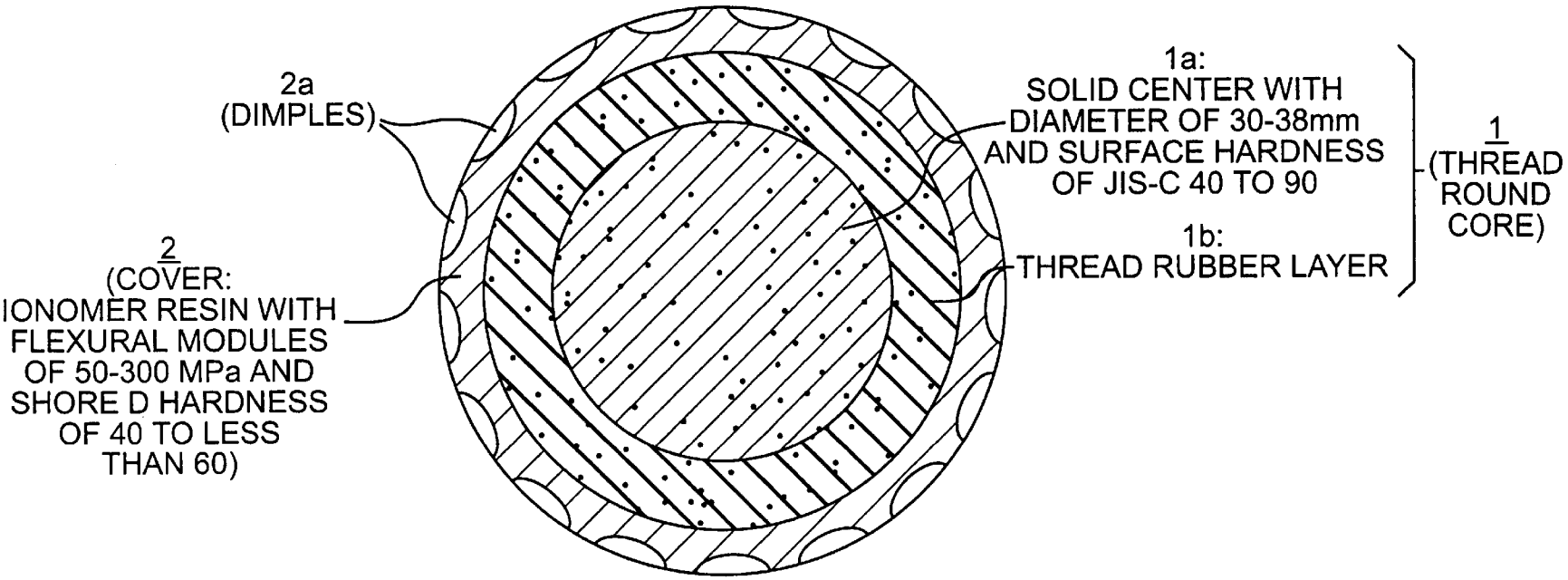
FIG. 1 is a schematic cross section illustrating one embodiment of the golf ball of the present invention.

The present invention is to provide a multi-layer structured golf ball having a thread rubber layer, exhibiting long flight distance equal to the two piece solid golf ball while maintaining an excellent shot feel and easy applicability of spin with the short irons. Thus, the present invention provides a golf ball which comprises a thread wound core and a cover covering the thread wound core, the thread wound core comprising a solid center and a thread rubber layer formed by winding thread rubber around the solid center, wherein the solid center has a diameter of 30 to 38 mm, a surface hardness, determined by JIS-C hardness meter, of 40 to 90 and a hardness difference between the center point and the surface, determined by JIS-C hardness meter, of within 5, the solid center also has a deformation amount of 0.5 to 2.5 mm, the deformation amount being determined by applying a weight of from an initial load of 10 Kg to a final load of 30 Kg on the solid center and measuring a change of the deformation of the solid center by mm, and the cover is formed from a base resin mainly containing an ionomer resin and has a flexural modulus of 50 to 300 MPa and a Shore D hardness of 40 to less than 60.

DETAILED DESCRIPTION OF THE INVENTION

The solid center used in the present invention has a diameter of 30 to 38 mm, which is larger than that of conventional one, a surface hardness, determined by a JIS-C hardness meter, of 40 to 90 and a hardness difference between the center point and the surface, determined by JIS-C hardness meter, of within 5, which is lower than that of conventional one. If the center has a diameter of less than 30 mm, the spin amount increases too much and degrades flight performance. If the center has a diameter of more than 38 mm, the thread rubber layer reduces its thickness in turn and does not exhibit sufficient impact resilience, thus lowering flight distance. If the hardness difference between the center point and the surface is more than 5, the impact resilience of the golf ball would be reduced, thus degrading flight distance. The surface hardness of less than 40 degrades the impact resilience of the golf ball and that of more than 80 is too hard and degrades shot feel. The solid center preferably has a deformation amount of 0.5 to 2.5 mm when applying a weight from an initial load of 10 Kg to a final load of 30 Kg. When the deformation amount is less than 0.5 mm, the center is too hard and the resulting golf ball has very poor shot feel. If the deformation amount is more than 2.5 mm, the center is too soft and it is difficult to control to a suitable ball hardness, thus degrading initial velocity of the resulting golf ball.

The solid center is formed by vulcanizing a rubber composition which has been generally used for the solid centers of the multi-layer structured golf balls. The rubber composition generally contains a rubber component, a co-crosslinking agent and a crosslinking agent. The rubber component can be anyone which has been used for multi-layer structured golf balls, but is preferably high-cis polybutadiene or a rubber mixture mainly containing high-cis polybutadiene. The co-crosslinking agent is added for making uniform hardness throughout the center and can be a metal salt of α,β-unsaturated carboxylic acid, preferably zinc salt of acrylic acid or methacrylic acid. The co-crosslinking agent can be contained in the rubber composition in an amount of 10 to 30 parts by weight, based on 100 parts by weight of the rubber component. The crosslinking agent may be an organic peroxide, such as dicumyl peroxide. The crosslinking agent may be present in an amount of 0.5 to 3.0 parts by weight, based on 100 parts by weight of the rubber component.

The rubber composition for the solid center may further contain filler (such as zinc oxide, barium sulfate etc.), antioxidant and the like.

In order to obtain uniform hardness distribution throughout the center, the vulcanization of the center is preferably conducted in two steps, that is low temperature and long term vulcanization (e.g. 140 to 150° C. for 20 to 30 minutes) and high temperature and short term vulcanization (e.g. 160 to 170° C. for 5 to 10 minutes).

The thread rubber winding on the solid center can be that which has been used for the multi-layer structured golf balls. For example, the thread rubber may be prepared by vulcanizing a rubber composition which comprises a rubber selected from the group consisting of natural rubber and a mixture of natural rubber and synthetic polyisoprene, sulfur, a vulcanization aid, a vulcanization accelerator, an antioxidant and the like. The thread rubber is wound on the center in a stretched condition which Is known to the art to form a thread wound core.

The thread wound core is then covered with a cover material to obtain the golf ball of the present invention. In the present invention, the cover is formed from a base resin mainly containing an ionomer resin and has a flexural modulus of 50 to 300 MPa and a Shore D hardness of 40 to less than 60, which is softer than the ionomer cover for thread wound golf balls. The flexural modulus is determined according to ASTM-747, using a sample of a heat and press molded sheet having a thickness of about 2 mm, which has been stored at 23° C. for 2 weeks. The Shore D hardness is determined using a Shore D hardness meter against a sample obtained by piling three sheets, the sheet having been prepared for the determination of the flexural modulus. If the flexural modulus is less than 50 MPa or the Shore D hardness is less 40, the cover is too soft and has difficulty in molding. If the flexural modulus is more than 300 MPa or the Shore D hardness is more than 60, the cover is too hard and does not impart sufficient spin amount when hit by short irons, thus resulting in poor shot feel.

The base resin for the cover mainly contains an ionomer resin and shows the above mentioned flexural modulus and Shore D hardness. Typical examples of the base resins are the following:

(i) an ionomer resin, (ii) a heated mixture of an ionomer resin and an epoxy-modified thermoplastic elastomer, (iii) a heated mixture of an ionomer resin, a maleic anhydride-modified thermoplastic elastomer and a glycidyl group-modified thermoplastic elastomer, (iv) a heated mixture of an ionomer resin and a terpolymer of ethylene, unsaturated carboxyl ester and unsaturated carboxylic acid, and (v) a heated mixture of (a) an ionomer resin, (b) a maleic anhydride-modified thermoplastic elastomer or a thermoplastic elastomer having a terminal OH group, and (c) an epoxy-modified thermoplastic elastomer. In the above context, the term "modified" means that a specific group is introduced in polymer molecules. Accordingly, the "epoxy-modified" thermoplastic elastomer means a thermoplastic elastomer into which one or more epoxy groups are introduced.

The ionomer resin can be either a copolymer of ethylene and (meth)acrylic acid of which a portion of carboxylic acid groups is neutralized with metal ion, or a terpolymer of ethylene, (meth)acrylic acid and an ester of α,β-unsaturated carboxylic acid of which a portion of carboxylic acid groups is neutralized with metal ion. The term "(meth)acrylic acid" means acrylic acid, methacrylic acid or a combination thereof. Neutralization with metal ion is generally conducted on 5 to 80% by weight of the carboxylic acid group. The ionomer resin is preferably soft type and includes terpolymer ionomers, such as Hi-milan 1856 (Na), Hi-milan 1855 (Zn), Hi-milan AM 7316 (Zn) available from Mitsui Du Pont Polychemical Co., Ltd., Surlyn AD 8265 (Na), Surlyn AD 8269 (Na) available from Du Pont Co. in U.S.A. In the above, the Na and Zn in parentheses indicate kind of metal ion for neutralization.

The epoxy-modified thermoplastic elastomer is one having epoxy groups in the elastomer molecule, for example styrene-butadiene-styrene block copolymer having epoxy groups in the butadiene block, available from Daicel Chemical Industries, Ltd.

The glycidyl-modified thermoplastic elastomer is one having glycidyl groups in the elastomer molecule, which may be classified into the above mentioned epoxy-modified thermoplastic elastomer but it is separately expressed in the present specification in view of the peculiarity of glycidyl group. Typical examples of the glycidyl-modified thermoplastic elastomers are those available from Sumitomo Chemical Co., Ltd. as "Bondfast", such as ethylene-glycidyl methacrylate terpolymer, ethylene-glycidyl methacrylate-methyl acrylate terpolymer, ethylene-glycidyl methacrylate-vinyl acetate copolymer etc.; those available from Asahi Chemical Industry Co., Ltd. as "Toughtec Z 514" or "Toughtec Z 513", such as a glycidyl methacrylate adduct of hydrogenated styrene-butadiene-styrene (SBS) block copolymer; and those available from Du Pont Co. in U.S.A. as "Elvaloy-AS", such as ethylene-acrylic ester-glycidyl methacrylate terpolymer.

The maleic anhydride-modified thermoplastic elastomer is one having maleic anhydride groups in the elastomer molecule. Typical examples are those available from Asahi Chemical Industry Co., Ltd. as "Toughtec" series, such as a maleic anhydride adduct of hydrogenated styrene-butadiene-styrene block copolymer; those available from Sumitomo Chemical Co., Ltd. as "Bondine" series, such as ethylene-ethyl acrylate-maleic anhydride; and those available from Mitsui Du Pont Polychemical Co., Ltd. as "AR" series, such as a graft-modified polymer of ethylene-ethyl acrylate copolymer with maleic anhydride.

The terpolymer of ethylene, unsaturated carboxylic acid ester and unsaturated carboxylic acid includes ethylene-isobutyl acrylate-methaerylic acid terpolymer available from Mitsui Du Pont Polychemical Co., Ltd. as "Neucrel AN 4212C" and "Neucrel NO 805J".

The thermoplastic elastomer having a terminal OH group is one having a OH group at the terminal of the elastomer molecule, for example hydrogenated styrene-isoprene-styrene block copolymer.

The thermoplastic elastomers or terpolymers other than the ionomer resin are used in combination with the ionomer resin and a weight ratio of ionomer resin to the other polymers is preferably within the range of 95: 5 to 30: 70, more preferably 80: 20 to 40: 60.

In addition to the base resin, the cover may contain additives which are known to the art, for example pigment, dispersant, antioxidant, ultraviolet absorber, light stabilizer and the like, if necessary. The additives can be contained in an amount of 2 to 6% by weight based on the total weight of the cover material.

When the ionomer resin is combined with the other elastomer or polymer, the mixing is conducted at heated condition, for example at 150 to 260° C. for 1 to 20 minutes. The mixing is preferably conducted in an extruder.

A method for covering is not limited and can be one which has been used in this field. For example, a cover resin composition is prepared by mixing the above mentioned components and molded into half shells, and then the thread wound core is encapsulated with two of the half shells, followed by pressing at 130 to 170° C. for 1 to 5 minutes. Also, the cover resin composition is prepared and directly injection-molded onto the thread wound core. When forming the cover, dimples, recesses formed on the ball surface, may be formed. If necessary, the covered golf balls are painted or marked after forming the cover.

FIG. 1 is a schematic cross section illustrating one embodiment of the golf ball of the present invention. In FIG. 1, 1 is a thread wound core composed of a center 1*a* and a thread rubber layer 1*b*, 2 is a cover and 2*a* represents dimples. The center 1*a* is a solid center, and the cover 2 for covering the center is formed by a composition for cover having a flexural modulus of 50 to 300 MPa and a Shore D-scale hardness of 40 to 60.

A suitable number/embodiment of dimples 2*a* are optionally provided on the cover 2 of the golf ball so that desired characteristics may be obtained. In addition, painting or marking is optionally provided on the surface of the golf ball.

As described above, according to the present invention, there could be provided a multi-layer structure golf ball having a thread rubber layer, which has good shot feel and controllability as well as satisfactory flight performance and cut resistance and excellent durability.

EXAMPLES

The following Examples and Comparative Examples further illustrate the present invention in detail but are not to be construed to limit the scope thereof.

Examples 1 to 7 and Comparative Examples 1 to 7

Each solid center was prepared from the rubber composition and vulcanizing condition disclosed in Tables 1 and 2. The number for components in Tables 1 and 2 indicates parts by weight. Then, thread rubber was prepared from a blend rubber of natural rubber and low-cis isoprene rubber (available from Shell Chemical Co., as Shell IR-309) in a weight ratio of 30/70 and wound on the solid center to form a thread wound core having a diameter of about 39.0 mm. In Tables 1 and 2, the diameter, weight and deformation amount of each center are also shown. Hardness distribution of the center was also measured by a JIS-C hardness meter on the center and the results are shown in Tables 1 and 2.

TABLE 1

| | A | B | C | D |
|---|---|---|---|---|
| Components | | | | |
| BR 11*1 | 100 | 100 | 100 | 100 |
| Zinc acrylate | 20 | 20 | 20 | 20 |
| Dicumyl peroxide | 1.5 | 1.5 | 1.5 | 1.5 |
| Zinc oxide | 15 | 15 | 15 | 15 |
| Barium sulfate | 84 | 40 | 40 | 11 |
| Antioxidant*2 | 0.5 | 0.5 | 0.5 | 0.5 |
| Vulcanization condition (° C. × minutes) | 145 × 24<br>165 × 8 | 145 × 24<br>165 × 8 | 165 × 20 | 145 × 24<br>165 × 8 |
| Center | | | | |
| Diameter (mm) | 28 | 34 | 34 | 38.5 |
| Weight (g) | 17.5 | 27.0 | 27.0 | 34.5 |

TABLE 1-continued

| | A | B | C | D |
|---|---|---|---|---|
| Deformation amount (mm) | 1.1 | 1.1 | 1.3 | 1.2 |
| Hardness distribution | | | | |
| Center point | 72 | 72 | 63 | 72 |
| 5 mm from the center point | 72 | 72 | 65 | 72 |
| 10 mm from the center point | 72 | 72 | 69 | 72 |
| 15 mm from the center point | — | 72 | 73 | 72 |
| Surface | 71 | 71 | 73 | 71 |

TABLE 2

| | E | F | G | H |
|---|---|---|---|---|
| Components | | | | |
| BR 11*1 | 100 | 100 | 100 | 100 |
| Zinc acrylate | 8 | 30 | 5 | 35 |
| Dicumyl peroxide | 1.5 | 1.5 | 1.5 | 1.5 |
| Zinc oxide | 15 | 15 | 15 | 15 |
| Barium sulfate | 67 | 18 | 44 | 36 |
| Antioxidant*2 | 0.5 | 0.5 | 0.5 | 0.5 |
| Vulcanization condition (° C. × minutes) | 145 × 24<br>165 × 8 | 145 × 24<br>165 × 8 | 145 × 24<br>165 × 8 | 145 × 24<br>165 × 8 |
| Center | | | | |
| Diameter (mm) | 30 | 36 | 34 | 34 |
| Weight (g) | 20.7 | 30.2 | 27.0 | 27.0 |
| Deformation amount (mm) | 2.3 | 0.7 | 2.7 | 0.4 |
| Hardness distribution | | | | |
| Center point | 51 | 82 | 38 | 92 |
| 5 mm from the center point | 51 | 82 | 38 | 92 |
| 10 mm from the center point | 52 | 82 | 38 | 92 |
| 15 mm from the center point | — | 82 | 38 | 92 |
| Surface | 51 | 81 | 37 | 91 |

*1High cis-polybutadiene available from Japan Synthetic Rubber Co., Ltd., having 1,4-cis-polybutadiene content of 96%.
*2,5-Di-t-butylhydroquinone available from Ouchi Shinko Kagaku Kokyo K.K. as Noclac NS-6.

Production of Composition For Cover

The formulation materials shown in Table 3 were mixed using a kneading type twin-screw extruder to obtain a pelletized cover compositions. The formulation amount described in Table 3 is represented by parts by weight. With respect to those represented by the trade name in Table 3, the details will be explained at the back of Table 3.

The extrusion conditions were as follows: a screw diameter: 45 mm; a screw revolution per minute: 200 rpm; a screw L/D: 35. The formulation materials were heated to 200–260° C. at the die position of the extruder. Then, the flexural modulus and Shore D-scale hardness of the resulting cover composition were measured. The flexural modulus was measured according to ASTM D-747 after a sheet having a thickness of about 2 mm obtained by heat-press molding was preserved at 23° C. for two weeks. The Shore D-scale hardness was measured according to ASTM D-2240 after a sheet having a thickness of about 2 mm obtained by heat-press molding was preserved at 23° C. for two weeks. These results are shown in Table 3, together with the composition of the cover composition.

TABLE 3

| | Cover composition | | | | | | |
|---|---|---|---|---|---|---|---|
| | a | b | c | d | e | f | g |
| Hi-milan 1605*3 | 0 | 0 | 0 | 20 | 0 | 20 | 50 |
| Hi-milan 1557*4 | 0 | 0 | 0 | 5 | 0 | 0 | 0 |
| Hi-milan 1855*5 | 15 | 0 | 20 | 75 | 0 | 30 | 0 |
| Hi-milan 1706*6 | 0 | 0 | 0 | 0 | 0 | 20 | 50 |
| Hi-milan AM 7316*7 | 85 | 0 | 0 | 0 | 0 | 0 | 0 |
| Surlyn AD8511*8 | 0 | 30 | 25 | 0 | 25 | 0 | 0 |
| Surlyn AD8512*9 | 0 | 30 | 25 | 0 | 25 | 0 | 0 |
| Neucrel AN4212C*10 | 0 | 0 | 0 | 0 | 0 | 30 | 0 |
| Toughtec Z 514*11 | 0 | 25 | 20 | 0 | 0 | 0 | 0 |
| Bondline AX 8390*12 | 0 | 0 | 10 | 0 | 0 | 0 | 0 |
| AR-201*13 | 0 | 15 | 0 | 0 | 0 | 0 | 0 |
| ESBS A 1010*14 | 0 | 0 | 0 | 0 | 15 | 0 | 0 |
| HG-252*15 | 0 | 0 | 0 | 0 | 35 | 0 | 0 |
| Titanium dioxide | 2 | 2 | 2 | 2 | 2 | 2 | 2 |
| Barium sulfate | 2 | 2 | 2 | 2 | 2 | 2 | 2 |
| Shore D hardness | 37 | 47 | 50 | 56 | 52 | 54 | 63 |
| Flexural modulus (MPa) | 34 | 130 | 135 | 150 | 90 | 150 | 340 |

*3Hi-milan 1605 (trade name), ethylene-methacrylic acid copolymer ionomer resin obtained by neutralizing with a sodium ion, manufactured by Mitsui DuPont Polychemical Co., Ltd., Ml (melt index): 2.8, flexural modulus: 310 MPa, Shore D-scale hardness: 62

*4Hi-milan 1557 (trade name), ethylene-methacrylic acid copolymer ionomer resin obtained by neutralizing with a zinc ion, manufactured by Mitsui DuPont Polychemical Co., Ltd., Ml: 5.0, flexural modulus: about 230 MPa

*5Hi-milan 1855 (trade name), ethylene-butyl acrylate-methacrylic acid terpolymer ionomer resin obtained by neutralizing with zinc ion, manufactured by Mitsui DuPont Polychemical Co., Ltd., Ml: 1.0, flexural modulus: about 90 MPa, Shore D-scale hardness: 55

*6Hi-milan 1706 (trade name), ethylene-methacrylic acid copolymer ionomer resin obtained by neutralizing with zinc ion, manufactured by Mitsui DuPont Polychemical Co., Ltd., Ml: 0.8, flexural modulus: about 260 MPa

*7Hi-milan AM 7316 (trade name), ethylene-butyl acrylate-methacrylic acid copolymer ionomer resin obtained by neutralizing with zinc ion, manufactured by Mitsui DuPont Polychemical Co., Ltd., Ml: 1.5, flexural modulus: about 24 MPa

*8Surlyn AD8511 (trade name), ethylene-methacrylic acid copolymer ionomer resin obtained by neutralizing with zinc ion, manufactured by DuPont Co., Ml: 3.4, flexural modulus: about 220 MPa, Shore D-scale hardness: 60

*9Surlyn AD8512 (trade name), ethylene-methacrylic acid copolymer ionomer resin obtained by neutralizing with sodium ion, manufactured by DuPont Co., Ml: 4.4, flexural modulus: about 280 MPa, Shore D-scale hardness: 62

*10Neucrel AN4212C (trade name), ethylene-isobutyl acrylate-methacrylic acid terpolymer resin [polymerization composition ratio: 76/20/4 (weight ratio)], manufactured by DuPont Co., Ml: 12

*11Toughtec Z 514 (trade name), a methacrylic glycidyl adduct of hydrogenated styrene-butadiene-Styrene block copolymer, available from Asahi Chemical Industry Co., Ltd., JIS-A hardness = 84, styrene content = about 30 wt 5; hydrogenated butadiene content = about 70 wt %; methacrylic glycidyl content = about 1 wt %

TABLE 3-continued

| | Cover composition | | | | | | |
|---|---|---|---|---|---|---|---|
| | a | b | c | d | e | f | g |

*12Bondine AX8390 (trade name), ethylene-ethyl acrylate-maleic anhydride terpolymer resin, manufactured by Sumitomo Chemical Industries Co., Ltd., Ml: 7.0, Shore D-scale hardness: 14, content of ethyl acrylate + maleic anhydride: 32% (content of maleic anhydride: 1–4%)

*13AR-201 (trade name), product obtained by graft-modifying ethylene-ethyl acrylate copolymer with maleic anhydride, manufactured by Mitsui DuPont Polychemical Co., Ltd., JIS-A hardness: 51

*14ESBS A1010 (trade name), SBS structure block copolymer having a polybutadiene block containing epoxy groups, manufactured by Daicel Chemical Industries, Ltd., JIS-A hardness: 67, styrene/butadiene (weight ratio: 40/60), content of epoxy: about 1.5–1.7% by weight

*15HG-252 (trade name), hydrogenated styrene-isoprene-styrene block copolymer having a terminal OH group, manufactured by Kuraray Co., Ltd., JIS-A hardness: 80, content of styrene: 40% by weight

Production of Golf Ball

A semi-spherical half-shell was molded from the cover composition of the above and the thread wound core obtained above was covered with two half-shells, followed by press-molding in a mold for ball at 150° C. for 2 minutes to cover the thread wound core with a cover. Then, a paint was applied on the surface to produce a thread wound golf ball having an outer diameter of 4.8 mm, Combinations of the center and cover used in the production of the golf ball are shown in Tables 4 and 5, together with the ball physical properties described hereinafter.

(Test method)

(1) Flight Performance 1

A No. 1 wood club (driver) was equipped with a swing robot available from True Temper Co., and a golf ball was hit by it at a head speed of 45 m/sec. The ball initial velocity, flight distance (carry) and spin amount of the golf ball were measured. The ball initial velocity was measured by the R&A initial velocity measuring method. The flight distance is the distance travelled by the ball before bouncing. The spin amount was measured by taking a photograph of a mark provided on the hit golf ball using a high-speed camera.

(2) Flight Performance 2

A sand wedge was equipped with a swing robot available from True Temper Co., and a golf ball was hit by it at a head speed of 20 m/sec. The flight distance (carry), spin amount and run of the golf ball were measured. The spin amount was measured by taking a photograph of a mark provided on the hit golf ball using a high-speed camera. The flight distance (carry) is a distance travelled by the ball before bouncing. The run is a distance rolled after bouncing on the ground.

TABLE 4

| | Example numbers | | | | | | |
|---|---|---|---|---|---|---|---|
| | 1 | 2 | 3 | 4 | 5 | 6 | 7 |
| Center formulation | B | B | B | B | B | E | F |
| Cover formulation | b | c | d | e | f | e | e |

TABLE 4-continued

| | Example numbers | | | | | | |
|---|---|---|---|---|---|---|---|
| | 1 | 2 | 3 | 4 | 5 | 6 | 7 |
| Flight performance 1 | | | | | | | |
| Initial velocity (m/sec) | 64.0 | 64.1 | 64.2 | 64.2 | 64.2 | 64.3 | 64.3 |
| Spin amount (rpm) | 2700 | 2730 | 2780 | 2720 | 2760 | 2740 | 2690 |
| Carry (yards) | 225.0 | 225.3 | 226.2 | 225.8 | 226.0 | 225.6 | 226.3 |
| Flight performance 2 | | | | | | | |
| Spin amount (rpm) | 7900 | 7850 | 7770 | 7830 | 7800 | 7860 | 7790 |
| Carry (yards) | 27.0 | 27.1 | 27.2 | 27.2 | 27.2 | 27.0 | 27.2 |
| Run (yards) | 0.5 | 0.6 | 0.7 | 0.6 | 0.7 | 0.5 | 0.7 |

TABLE 5

| | Comparative Example | | | | | | |
|---|---|---|---|---|---|---|---|
| | 1 | 2 | 3 | 4 | 5 | 6 | 7 |
| Center formulation | A | C | D | B | B | G | H |
| Cover formulation | b | b | b | a | g | e | e |
| Flight performance 1 | | | | | | | |
| Initial velocity (m/sec) | 64.2 | 63.3 | 63.0 | 63.8 | 64.5 | 63.1 | 64.4 |
| Spin amount (rpm) | 3010 | 2690 | 2650 | 2980 | 2650 | 2580 | 3020 |
| Carry (yards) | 221.5 | 222.0 | 221.0 | 220.8 | 226.5 | 220.6 | 222.3 |
| Flight performance 2 | | | | | | | |
| Spin amount (rpm) | 7910 | 7880 | 7850 | 8100 | 6700 | 6500 | 7900 |
| Carry (yards) | 27.0 | 27.1 | 27.3 | 26.8 | 28.0 | 27.5 | 27.0 |
| Run (yards) | 0.5 | 0.6 | 0.7 | 0.4 | 1.8 | 1.5 | 0.5 |

In the comparison of Example 1 with Comparative Examples 1–3, the balls had the same cover and therefore had no difference in spin amount by a sand wedge. However, when it was hit by a driver, the golf ball of Comparative Example 1 exhibited too much spin amount, thus reducing flight distance, and the golf balls of Comparative Examples 2 and 3 exhibited low initial velocity, thus reducing flight distance. The golf ball of Comparative Example 4 had very soft cover and when hit by a driver, exhibited too much spin amount, thus reducing flight distance. The golf ball of Comparative Example 5 had harder cover and when hit by a driver exhibited long flight distance but when hit by a sand wedge exhibited lower spin amount, thus showing too much run. The golf ball of Comparative Example 6 had very soft center and when hit by a driver exhibited lower initial velocity, thus reducing flight distance, and when hit by a sand wedge, exhibited poor spin amount. The golf ball of Comparative Example 7 had very hard center and when hit by a driver exhibited too much spin amount, which caused its trajectory blowing up by air resistance and reduced flight distance.

What is claimed is:

1. A golf ball comprising a thread wound core and a cover covering the thread wound core, the thread wound core comprising a solid center and a thread rubber layer formed by winding thread rubber around the solid center, wherein the solid center has a diameter of 30 to 38 mm, a surface hardness, determined by JIS-C hardness meter, of 40 to 90 and a hardness difference between the center point and the surface, determined by JIS-C hardness meter, of within 5, the solid center also has a deformation amount of 0.5 to 2.5 mm, the deformation amount being determined by applying a weight of from an initial load of 10 Kg to a final load of 30 Kg on the solid center and measuring a change of the deformation of the solid center by mm, and the cover has a flexural modulus of 50 to 300 MPa and a Shore D hardness of 40 to less than 60 and is formed from a heated mixture of an ionomer resin and another resin selected from the group consisting of (i) an epoxy-modified thermoplastic elastomer, (ii) a combination of maleic anhydride-modified thermoplastic elastomer and a glycidyl group-modified thermoplastic elastomer, (iii) a terpolymer of ethylene, unsaturated carboxyl ester and unsaturated carboxylic acid, and (iv) a combination of an epoxy-modified thermoplastic elastomer and either a maleic anhydride-modified-thermoplastic elastomer or a thermoplastic elastomer having a terminal OH group.

* * * * *